US006705493B1

(12) United States Patent
Mijers

(10) Patent No.: US 6,705,493 B1
(45) Date of Patent: Mar. 16, 2004

(54) DISPENSER FOR LIQUIDS OR FOR VISCOUS OR SPRAYABLE PRODUCTS

(75) Inventor: J. W. M. Mijers, Venlo (NL)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 127 days.

(21) Appl. No.: 10/049,974

(22) PCT Filed: Aug. 12, 2000

(86) PCT No.: PCT/EP00/07882

§ 371 (c)(1),
(2), (4) Date: Feb. 14, 2002

(87) PCT Pub. No.: WO01/12338

PCT Pub. Date: Feb. 22, 2001

(30) Foreign Application Priority Data

Aug. 16, 1999 (DE) ..... 199 38 798

(51) Int. Cl.[7] ..... B65D 88/54
(52) U.S. Cl. ..... 222/321.7; 222/383.1
(58) Field of Search ..... 222/321.7, 321.9, 222/321.2, 321.8, 383.1, 385, 384, 341, 380, 335; 239/331, 333; 417/558, 560, 566, 571

(56) References Cited

U.S. PATENT DOCUMENTS

| | | | | | |
|---|---|---|---|---|---|
| 1,484,920 | A | * | 2/1924 | Wolfe | 222/341 |
| 2,214,714 | A | * | 9/1940 | Bates | 222/205 |
| 3,820,689 | A | | 6/1974 | Cocita | |
| 4,084,731 | A | * | 4/1978 | Ayres | 222/380 |
| 4,225,063 | A | * | 9/1980 | Ayres | 222/380 |
| 4,227,628 | A | * | 10/1980 | Parsons | 222/380 |
| 4,396,132 | A | * | 8/1983 | Christensen | 222/1 |
| 4,515,298 | A | | 5/1985 | Czech | |
| 5,024,355 | A | * | 6/1991 | Jouillat et al. | 222/162 |
| 5,238,156 | A | * | 8/1993 | Andris | 222/207 |
| 5,351,862 | A | * | 10/1994 | Weag | 222/145.3 |
| 5,361,944 | A | | 11/1994 | Hauf | |
| 5,577,640 | A | * | 11/1996 | Albini et al. | 222/378 |
| 5,848,881 | A | * | 12/1998 | Frezza | 417/560 |

FOREIGN PATENT DOCUMENTS

| | | | | |
|---|---|---|---|---|
| DE | 4121834 A1 | * | 1/1993 | B65D/35/40 |
| DE | 197 13 720 A1 | | 1/1999 | |
| DE | 297 17 034 U1 | | 1/1999 | |
| DE | 198 16 399 A1 | | 10/1999 | |
| GB | WO-9706842 A | * | 2/1997 | A61M/15/00 |

* cited by examiner

*Primary Examiner*—Gene Mancene
*Assistant Examiner*—Frederick Nicolas
(74) *Attorney, Agent, or Firm*—Quarles & Brady LLP

(57) ABSTRACT

Disclosed is a dispenser for liquids or for viscous or sprayable products to which a disposable container is tightly attached and to which a dosage device is attachable. The inventive dispenser is provided with a cylinder-housing (3), suction or compression cylinders which can be moved back and forth (1) and a valve between the suction and pressure cylinders. For the purpose of producing a dispenser suitable for liquids of differing consistencies which avoids contact between the liquid and metal parts and the invasion of bacteria in the air, the invention proposes that the cylinder housing at one end accommodates the cylinder (1) which has a pressure spring (2) located in a recess and that at the other end a valve seat (5) is provided with a membrane disk (4) which is stretched at the periphery thereof in order to close off the container or open the through-flow from said container.

21 Claims, 8 Drawing Sheets

DISPENSER FOR LIQUIDS OR FOR VISCOUS OR SPRAYABLE PRODUCTS

Figure 1:
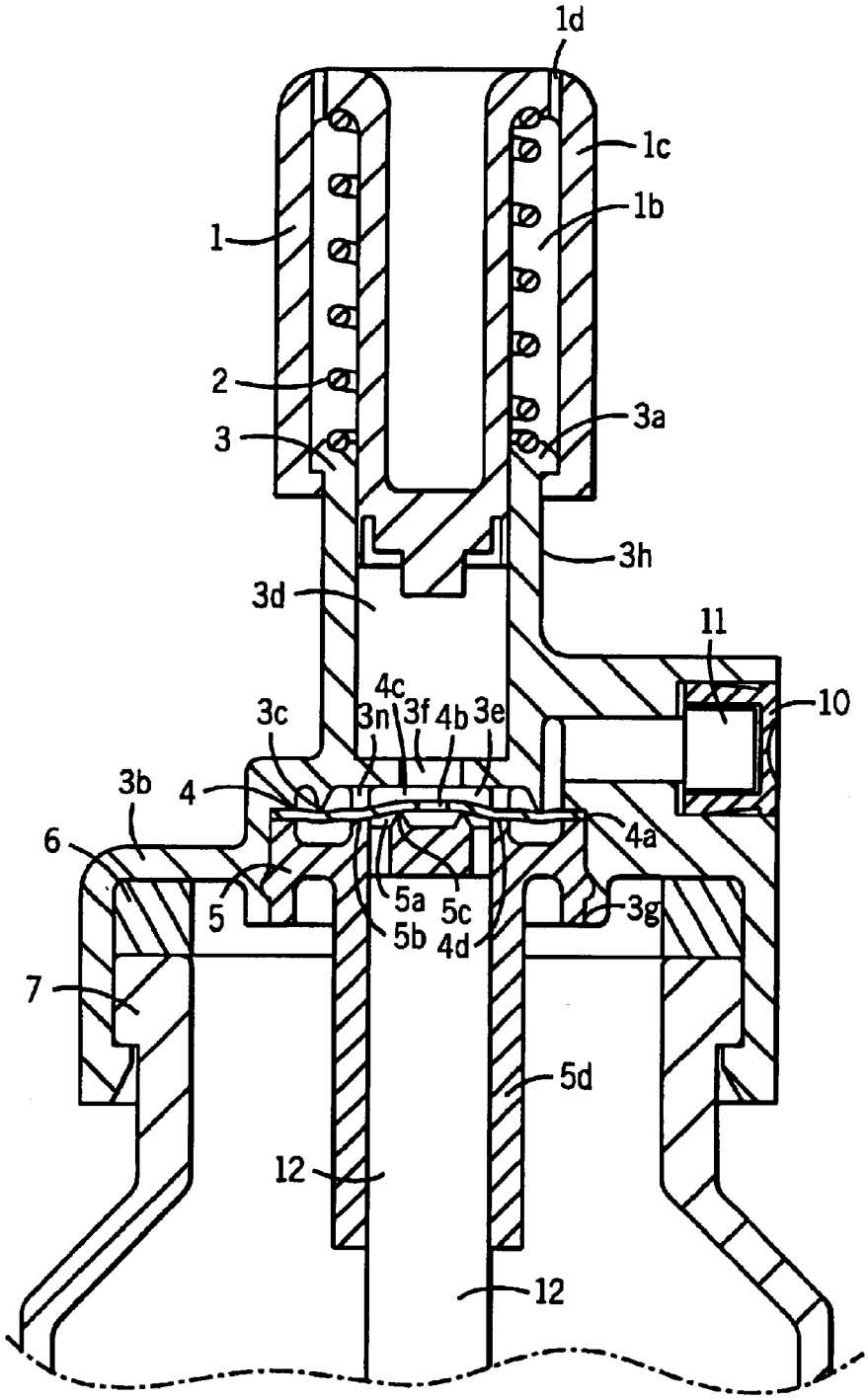

The description relates to a dispenser for liquids, or for viscous or sprayable products, to which is interchangeably tightly fitted a storage container and which is connectable to a dosing device, with a suction or pressure piston movable backwards and forwards in a cylinder housing and a valve between the suction and pressure sides.

Such dispensers are in every day use, e.g. as soap dispensers, lotion or cream dispensers, gels, liquid detergents, but also in the pharmaceutical sector as atomizers for medicaments. Whereas in the case of every day liquids such great importance is not attached to the special features of the chemical behaviour, this question is of considerable importance with medicaments. The components used in medicament spray containers are pump systems with in each case a unit formed from a connecting piece, sealing housing, piston with a compression spring and with a ball. As the balls and compression springs for functional reasons are made from steel or stainless steel, within a short time between the medicament liquid and the material steel chemical reactions can occur, which modify the fundamental substance of the medicament, so that such a pump system is not allowed for medicaments.

Medicamentous treatment by spraying ultra-fine droplets into the nose has increased greatly over the last few years. Three fundamental demands are made on such systems, namely reliability, safety and effectiveness. However, these conditions are not fulfilled with nose drops either for children or adults. One of the prerequisites is that the liquid is sealed by a valve from the environment in order to prevent the access of oxygen, bacilli and bacteria. Thus, known systems comprise a connection to a spraying device, a sealed housing, a piston, a measuring chamber, a spring located therein, the cylinder for the piston and a ball as a valve. The medicament comes into contact with the steel ball and compression spring, which represents a disadvantage of such systems.

The problem of the invention is to provide a dispenser suitable for liquids of different consistency preventing contact of the liquid with the metal parts and access for atmospheric bacteria.

According to the invention this problem is solved in that the cylinder housing receives at one end the piston with a compression spring located in a cavity and where at the other end is provided a valve seat with a circumferentially fixed membrane disk for blocking in the storage container or opening the flow out of the storage container. The compression spring located in the interior is the only part made from steel and does not come into contact with the liquid, so that even medicaments intended for spraying can be sprayed without any risk of chemical changes. The membrane valve prevents access for bacteria contained in the air, so that also here the liquid is protected against contamination.

A protecting chamber system has further features according to which the membrane disk has a central connecting opening to the cylinder housing and that in the valve seat are provided passage openings in the storage container.

The opening and closing of the valve is brought about in that the membrane disk is clamped to an outer edge between the valve seat and the cylinder housing and passage channels are provided in the cylinder housing, that the membrane disk engages in pressure-dependent manner against a concentric, outer ring land of the cylinder housing and that the membrane disk rests in spaced, pressure-dependent manner on an annular sealing seat around the central connecting opening.

On sucking the liquid out of the storage container the sealing seat is opened and during the piston pressure stroke the sealing seat is closed in the direction of the storage container and freed to the dosing device.

Opening in the direction of the dosing device can advantageously take place in that the membrane disk is connected to the cylinder area and an upper area via the membrane disk to a suction or squeezing out opening for the dosing device.

An adequately large flow both in the suction direction and in the pressing direction is obtained in that the membrane disk with its connecting opening faces a suction or squeezing out opening of the cylinder housing. The connection between the valve seat and the cylinder housing is created in that on the side towards the storage container the valve seat forms a sealing locking connection.

According to further features the storage container comprises a transparent glass cylinder. Through the material glass, the container exerts no influence on the composition of the liquid.

From the constructional and manufacturing standpoint it is advantageous for an axially open glass cylinder to have a sealing clamping base made from a flexible material.

According to a further development of the invention, the liquid quantity is kept small without air bubble formation in that in the storage container is provided a flying piston adjustable by suction force.

The flying piston has a planar end face. The piston can be made from rubber or a plastics material able to slide easily on glass.

The surrounding of the steel compression spring can, according to other features of the invention, take place in that the cylinder housing has a hollow guide shaft for inner guidance of the sprung suction/compression piston.

According to further features the separate housing of the compression spring is made possible in that the compression spring is placed in a cavity of the sleeve-like suction/pressure piston.

The pressing of air to be vented out of the area receiving the compression spring can take place in that in the outer sleeve wall of the suction/pressure piston are provided axially directed vent ducts.

A further development provides for the valve seat passing concentrically to the locking connection into a mounting support for a suction tube. Such a suction tube can be used in place of the flying piston.

An alternative dispenser construction is obtained in that the cylinder housing is made angular and from the upper area the suction or squeezing out opening is led on as an angular channel or duct. The angle can both be a right angle and an acute angle. This leads to favourable ergonomic manipulations for gripping, holding and operating the dispenser.

To bring about a maximum space utilization for a large liquid volume, it is proposed that the valve seat directed towards the storage container is hollow and forms together with the locking connection a ring step, which is movable into a correspondingly shaped annular space of the flying piston.

When the cylinder housing is arranged angularly to the storage container axis, by means of a connection channel is connected an inner tube, which is equiaxial to the storage container axis.

Before using the dispenser the latter is advantageously sealed from the external air. For this purpose the inner tube which is connected to the dosing device is surrounded by a protective tube.

In use or operating intervals of the dispenser it is also advantageous that the inner tube with the dosing device and the protective tube are provided with a removable protective cap.

According to another alternative, which operates with the flying piston, it is proposed that under the valve seat is fixed a needle holding bush in the cylinder housing and that in said needle holding bush is fixed a hollow piercing needle, whose channel is connected to the passage openings. The invention is further developed in that in the storage container a second piston is provided below the needle holding bush, a flush-mounted inner contour corresponding to the outer contour of the needle holding bush, the locking connection and the ring step of the valve seat.

The liquid used as the liquid mass to be filled or the viscous liquid or the liquid to be atomized can be filled between the flying piston and the second piston during the manufacture and assembly of the dispenser.

Embodiments of the invention are described hereinafter relative to the attached drawings, wherein show:

FIG. 1 A vertical section through the upper area of the dispenser.

Figure 1A:
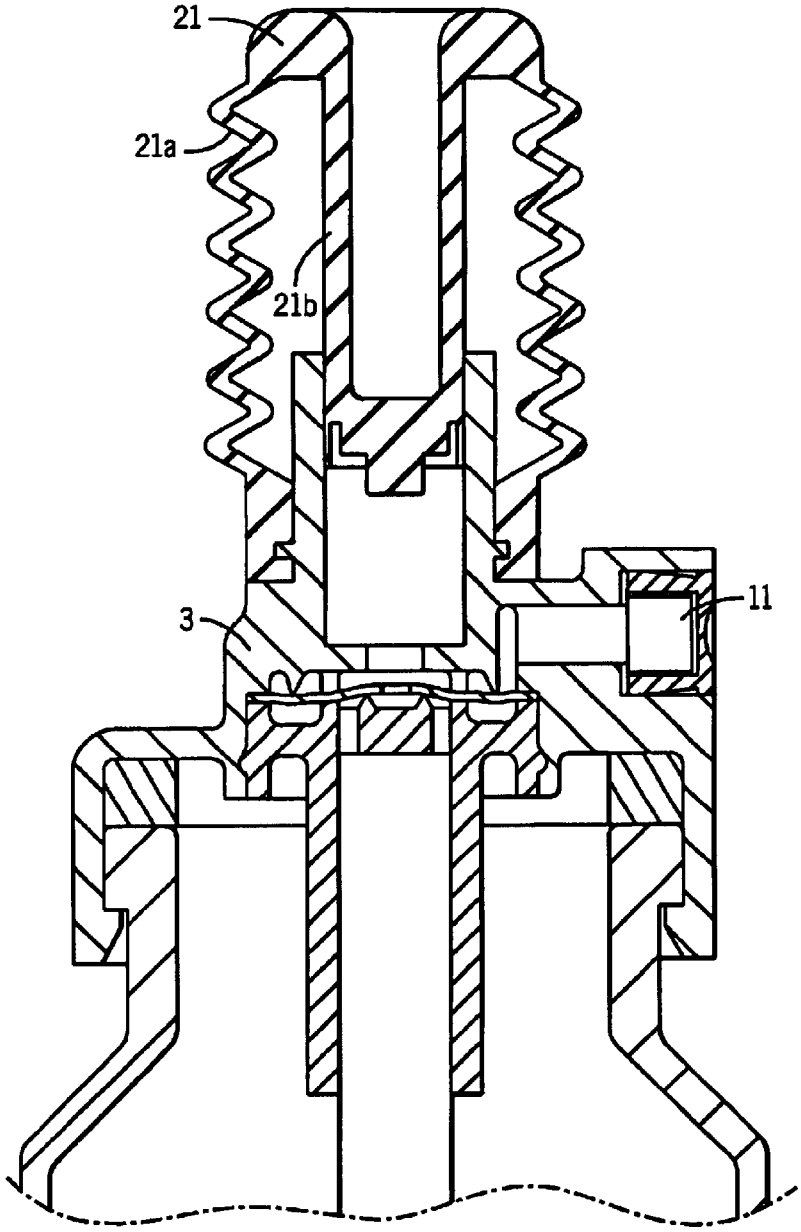

FIG. 1*a* A vertical section through a second embodiment of the dispenser.

Figure 1B:
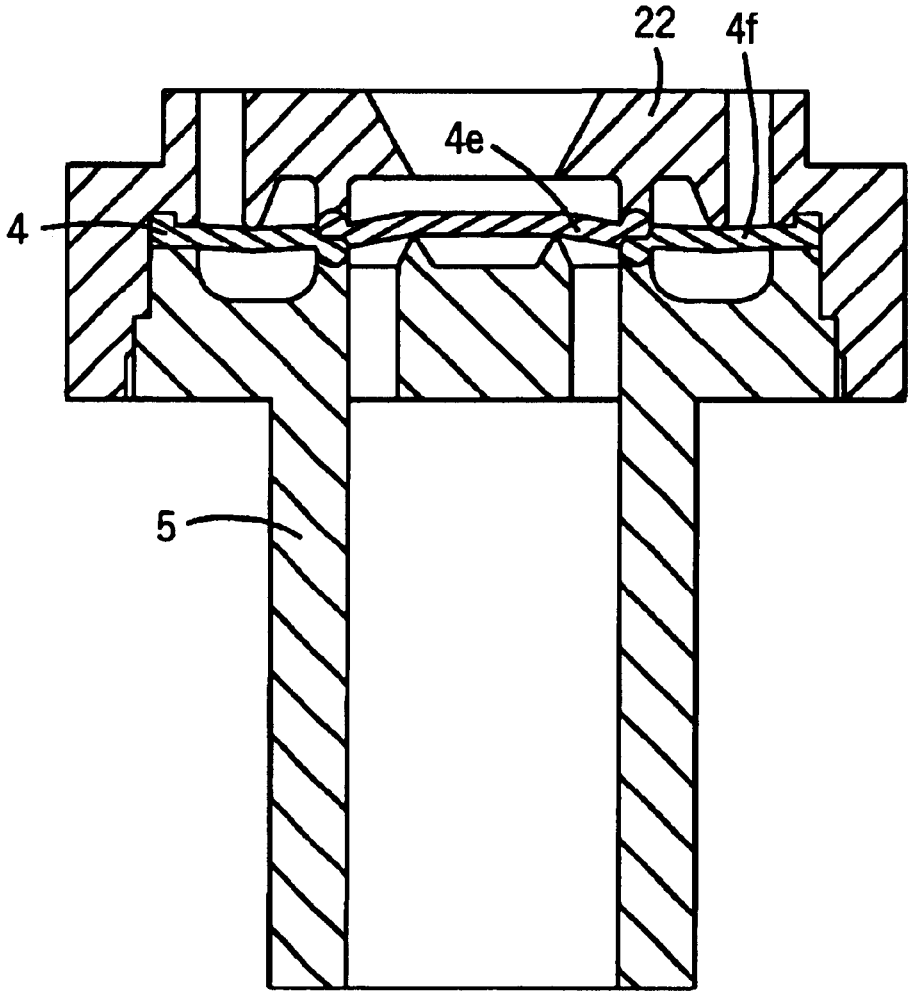

FIG. 1*b* A functional unit formed from a valve seat and a membrane.

Figure 2:
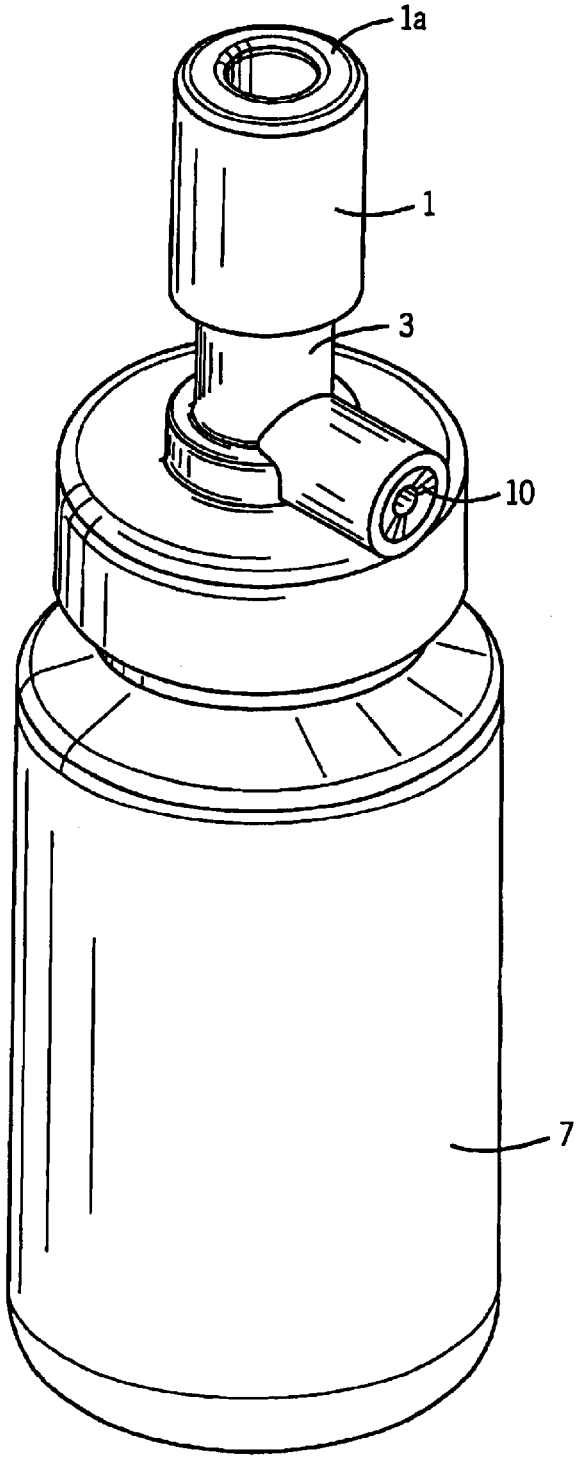

FIG. 2 A perspective outer view of the dispenser of FIG. 1.

Figure 3:
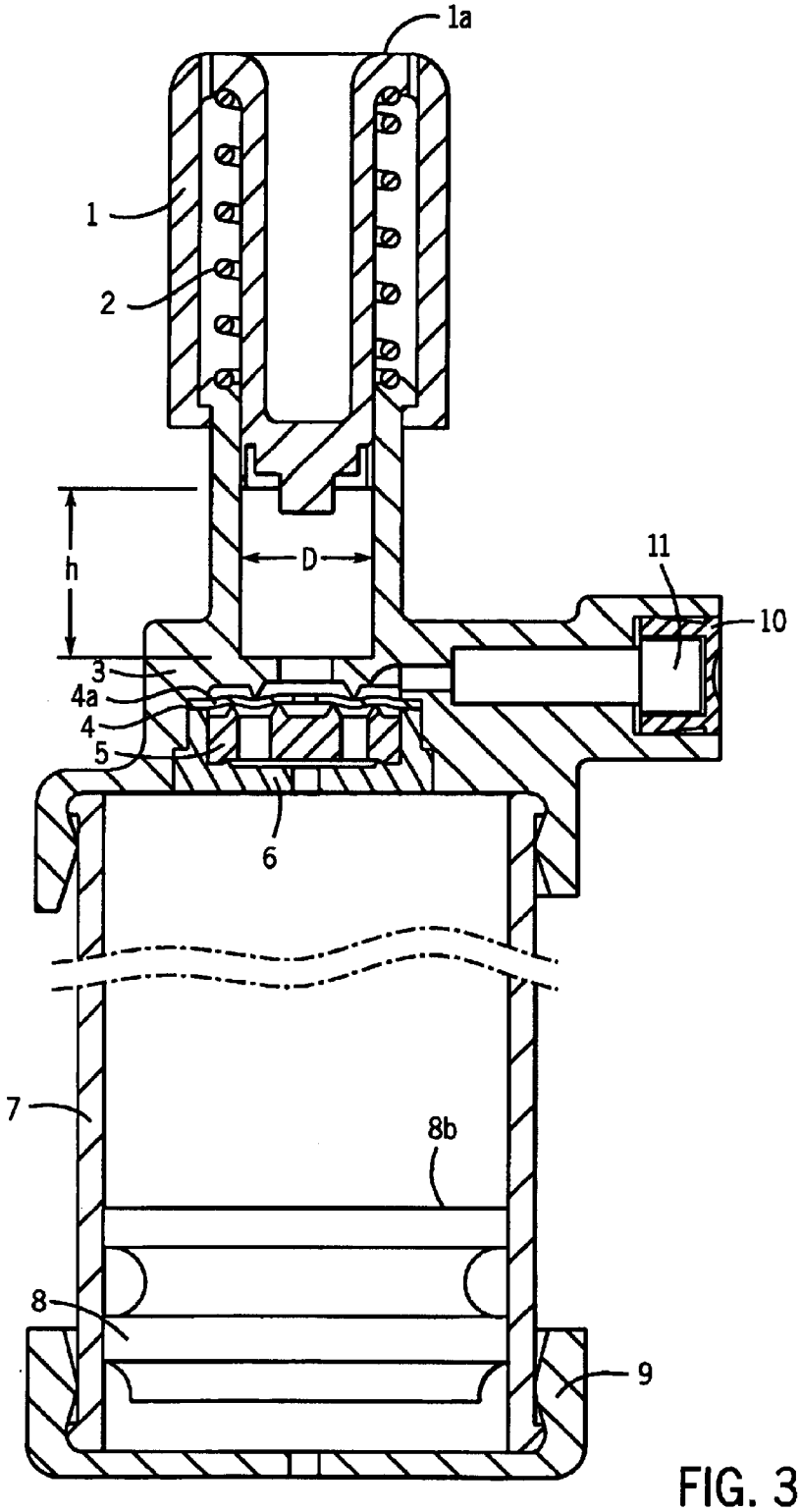

FIG. 3 An alternative embodiment of the dispenser with modified valve and storage container in section.

Figure 4:
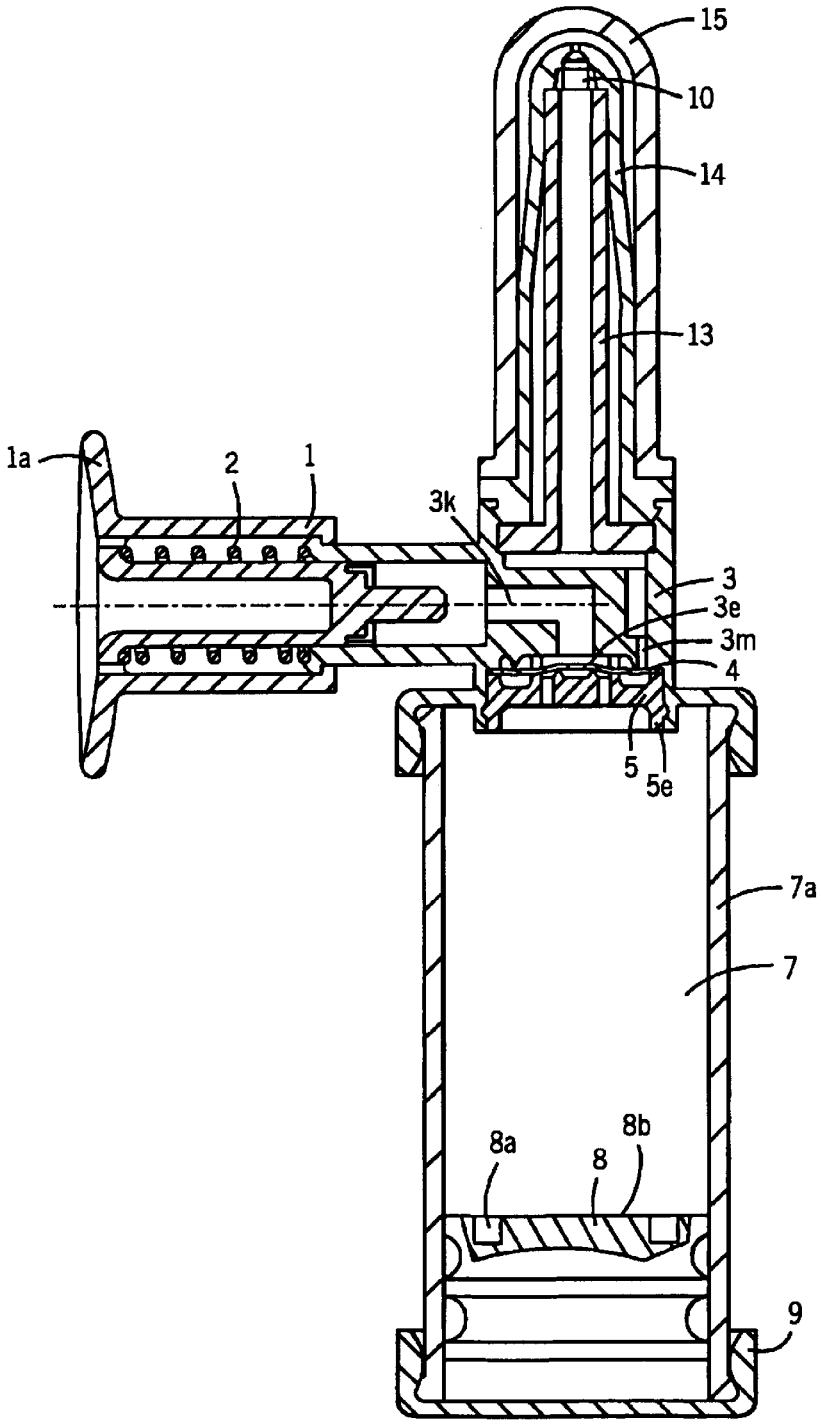

FIG. 4 Another alternative of an angular dispenser in section.

Figure 5:
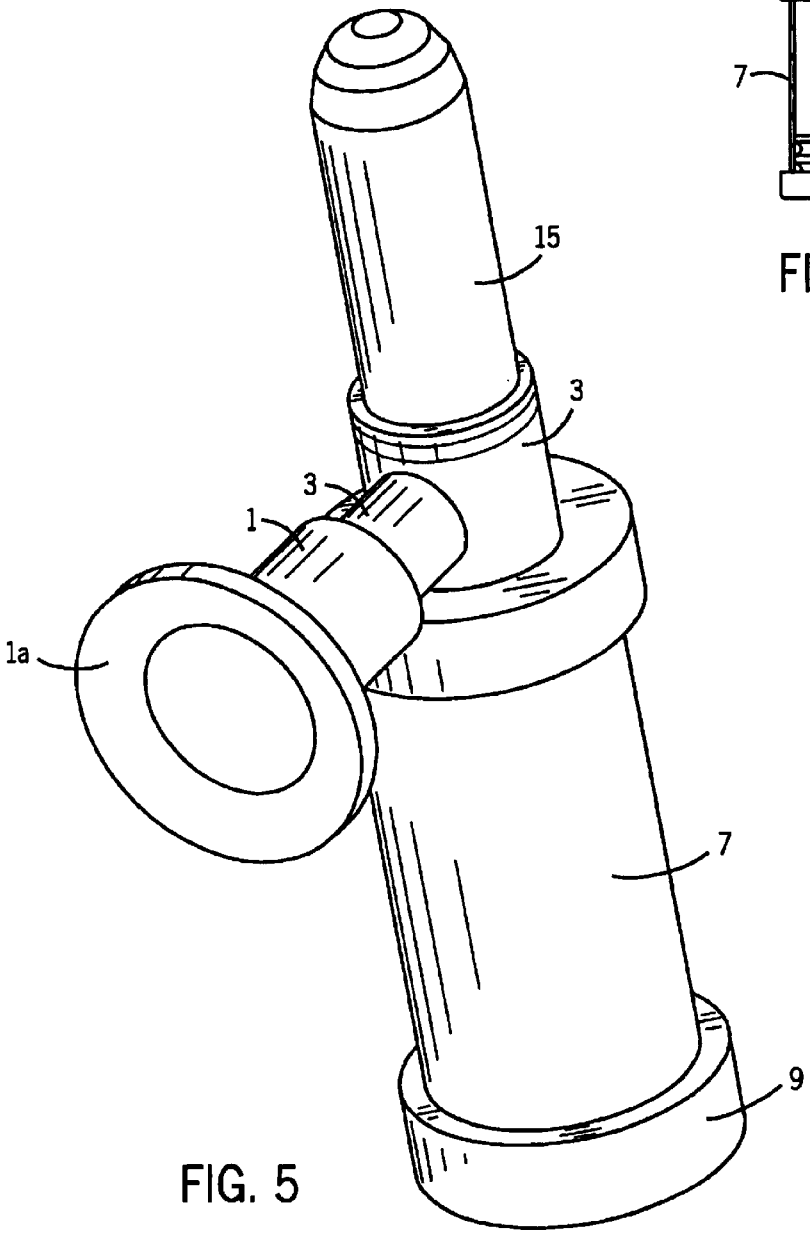

FIG. 5 A perspective outer view of the dispenser of FIG. 4.

Figure 6:
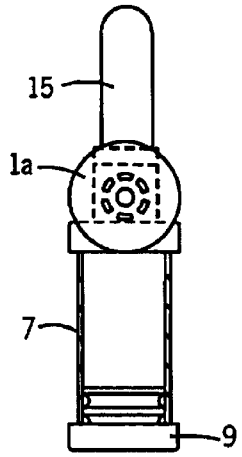

FIG. 6 A view of the dispenser in a scale of 1:1.

Figure 7:
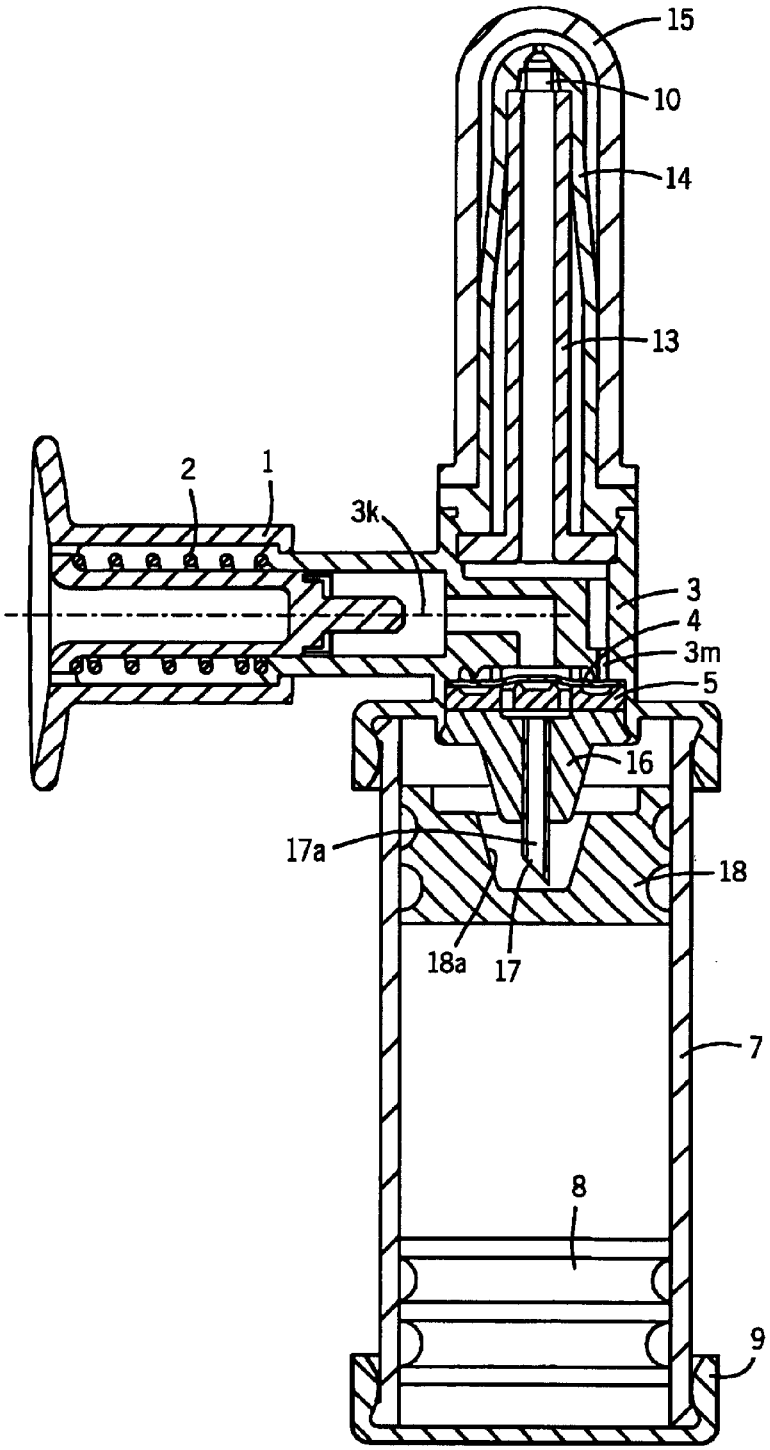

FIG. 7 A section through another alternative embodiment of the dispenser.

The dispenser according to FIG. 1 is intended for liquids of different consistency, viscosity and chemical analysis, such as e.g. for viscous or sprayable products and in particular also for medicaments, e.g. for nasal application. The dispenser has a replaceable storage container 7 connectable by means of a valve in the liquid path to a dosing device 10. A piston 1, as a suction or pressure piston, can be moved backwards and forwards in a cylinder housing 3. At one end 3*a* the cylinder housing 3 receives the piston 1 with a compression spring 2 located in a cavity 1*b* and at its other end 3*b* is provided a valve seat 5 with a membrane disk 4 fixed to the circumference 4*a* for blocking or opening the through-flow.

The membrane disk 4 has a central connecting opening 4*b* to the cylinder housing 3 and the valve seat 5 has passage openings 5*a* in the direction of the storage container 7. The membrane disk 4 is clamped to an outer edge between the valve seat and the cylinder housing, passage ducts 3*n* being provided in transversely directed manner in the cylinder housing 3. The membrane disk 4 also engages in pressure-dependent manner on a concentric, outer ring land 3*c* of the cylinder housing. In addition, the membrane disk 4 rests in pressure-dependent, spaced manner around the central connecting opening 4*b* on an annular sealing seat 5*c*. The membrane disk 4 is connected to the cylinder area 3*d* and an upper area 3*e* by means of the membrane disk 4 with a suction or squeezing opening 3*f* for the dosing device 10. The membrane disk 4 with its connecting opening 4*b* faces a suction or squeezing out opening 3*f* of the cylinder housing 3.

As soon as the piston 1 has been drawn upwards by the compression spring 2, the resulting vacuum sucks the membrane disk 4 away from the annular sealing seat 5*c*. Thus, the liquid is fed from the storage container 7 through the passage openings 5*a* and the connecting opening 4*b* in the membrane disk 4 and through the suction opening 3*f* in the cylinder area 3*d*. The membrane disk 4 seals off on the annular sealing seat 5*c*. The liquid in the cylinder area 3*d* flows radially outwards via the passage ducts 3*n* and opens the membrane disk 4 on ring land 3*c* and liquid flows into the dosing device 10. The dosing device 10 can also be constructed as a spray nozzle. If the dosing device 10 is fixed by locking in the cylinder housing 3, as a function of the intended application differently constructed dosing devices can be used.

The valve seat 5 is fixed in simple manner in that said valve seat 5 forms on the side towards the storage container 7 a sealing locking connection 3*g*.

The storage container 7 is made from a transparent glass cylinder 7*a*. The glass can also be coloured. In the case where the glass cylinder 7*a* only comprises a cylinder open on both sides, the cylinder housing 3 is shaped into a cover engaging behind the cylinder edge and between the latter and said cover is inserted a pressure piece 6 constituted by a glass ring in order to produce a toleranced tension. On the bottom is mounted an axially open glass cylinder 7*a* with a sealing, flexible material clamping base 9 (plastic).

FIG. 1*a* shows an embodiment modified compared with that of FIG. 1 in that the piston 1 and spring 2 are constructed as a one-piece part 21, which can in particular be manufactured by injection moulding. It can comprise one or two material components. At least the area 21*a* taking over the function of the spring is preferably made from thermoplastic material with a Shore hardness of 70 to 90° A. The piston area 21*b* can be made from more rigid plastic. The one-piece construction of the part 21 reduces the number of components required and simplifies final assembly.

FIG. 2 shows the size ratios and the shapes of the dispenser.

According to FIG. 3 in the storage container 7 is slidingly mounted a flying piston 8 adjustable by the suction force of the piston 1. The flying piston 8 has a planar end face 8*b*.

The cylinder housing 3 (FIGS. 1 and 3) has a hollow guide shaft for an internal guidance of the sprung suction or pressure piston 1 and for an external guidance of the sleeve-like suction or compression spring 1. The steel compression spring 2 is located in cavity 1*b*. Axially parallel vent ducts 1*d* are made in the outer sleeve wall 1*c* of the suction or pressure piston 1.

According to FIG. 1 the valve seat 5 passes concentrically to the locking connection 3*g* into a mounting support 5*d* for a suction tube 12.

According to an alternative construction (FIG. 4) the cylinder housing 3 can have an angular construction and the suction or squeezing out opening 3*f* is continued on from the upper area 3*e* in the form of an angular channel 3*k*. The valve seat 5 is hollow towards the storage container 7 and together with the locking connection 3*g* forms a ring step 5*e*, which can be moved into a correspondingly shaped annular area 8*a* of the flying piston 8.

If the cylinder housing 3 is arranged angularly to the axis of the storage container 7, by means of a connecting channel 3*m* an inner tube 13, which is equiaxial to the axis of the storage container 7, is connected. The inner tube, which is connected to the dosing device 10 with a filling piece 11, is surrounded by a protective tube. The inner tube 13 with the dosing device 10 and protective tube 14 are provided with a removable protective cap.

Standardization can be brought about in that a functional unit is formed from the membrane 4, valve seat 5 and cap 22, which acts as a two-way valve and is usable in numerous dispenser pumps, which can also have different sizes. Such a functional unit is shown in FIG. 1*b*. The membrane can for this purpose have an inner area 4*e* with a lower Shore hardness (e.g. approx. 55° A) and an outer area 4*f* with a higher Shore hardness (e.g. approx. 80° A). The area ratio between the acting surfaces and the ratio of the membrane hardness influence the switching points of the valve. For a constant valve geometry, they can be adapted to different working points by using corresponding membranes.

FIGS. 5 and 6 show the alternative dispenser perspectively and in its natural size. For ergonomic pressures (suction or pumping) a pressure surface 1*a* adapted to the finger is formed.

Below the valve seat 5 (FIG. 7) a needle holding bush 16 is fixed in the cylinder housing 3 and in the needle holding bush 16 is located a hollow piercing needle 17, whose channel 17*a* is connected to the passage openings 5*a*, on perforating a sealing wall of a second piston 18.

It is alternatively also possible for the end of the valve seat 5 facing the storage container 7 to be constructed as a Luer lock connection. The valve seat 5 is preferably the female part of the Luer lock connection. This makes it possible, whilst respecting hygiene and sterility conditions, to connect the storage container just prior to use to the dispenser and its valve seat 5.

After perforating the wall of the second piston 18 the needle holding bush 16, as a result of a flush-mounted inner contour 18*a* with the outer contour of the needle holding bush 16 is in contact with the locking connection 3*g* and ring step 5*e* of valve seat 5. The second piston 8 is drawn upwards by the suction stroke of stroke height "h" (cf. FIG. 3) in the case of a cylinder internal diameter "D". The liquid mass, viscous liquid or liquid to be sprayed or atomized and which is to be filled is introduced between the flying piston 8 and the second piston 18 during assembly.

A utilization of the maximum stroke height "h" of the piston 1 and an elimination of residual liquids are brought about inter alia according to FIG. 4 by the piston extension provided there with a stepped diameter, which in the case of advancing stroke is inserted in the angular channel 3*k* and according to FIGS. 1 or 3 the piston extension is inserted in the connecting opening 4*b*.

What is claimed is:

1. Dispenser for liquids, or for viscous or sprayable products, to which is interchangeably tightly fitted a storage container and which is connectable to a dosing device, having a suction or pressure piston movable backwards and forwards in a cylinder housing, and a valve between the suction and pressure sides, characterized in that the cylinder housing (3) receives at one end (3*a*) the piston (1) with a compression spring (2) located in a cavity (1*b*) and that at the other end (3*b*) is provided a valve seat (5) with a membrane disk (4) fixed at the circumference (4*a*) for blocking in storage container (7) or opening the flow out of the storage container (7).

2. Dispenser according to claim 1, characterized in that the membrane disk (4) has a central connecting opening (4*b*) to the cylinder housing (3) and that in the valve seat (5) passage openings (5*a*) are provided in the storage container (7).

3. Dispenser according to claim 1, characterized in that the membrane disk (4) is connected to the cylinder area (3*d*) and an upper area (3*e*) by means of the membrane disk (4) with a suction or squeezing opening (3*f*) for the dosing device (10).

4. Dispenser according to claim 1, characterized in that the membrane disk (4) with its connecting opening (4*b*) faces either a suction or a squeezing out opening (3*f*) of the cylinder housing (3).

5. Dispenser according to claim 1, characterized in that on the side towards the storage container (7), the valve seat (5) forms a sealing locking connection (3*g*).

6. Dispenser according to claim 1, characterized in that the storage container (7) comprises a transparent glass cylinder (7*a*).

7. Dispenser according to claim 1, characterized in that an axially open glass cylinder (7*a*) has a sealing clamping base (9) made from flexible material.

8. Dispenser according to claim 1, characterized in that in the storage container (7) is provided a flying piston (8) adjustable by suction force.

9. Dispenser according to one of the claims 1 to 8, characterized in that in the storage container (7) is provided a flying piston (8) adjustable by suction force.

10. Dispenser according to claim 1, characterized in that the cylinder housing (3) has a hollow guide shaft (3*h*) for an inner guidance of the sprung suction/pressure piston (1) and an external guidance of the sleeve-like suction/pressure piston (1).

11. Dispenser according to one of the claims 1 to 10, characterized in that the cylinder housing (3) has a hollow guide shaft (3*h*) for an inner guidance of the sprung suction/pressure piston (1) and an external guidance of the sleeve-like suction/pressure piston (1).

12. Dispenser according to claim 10, characterized in that axially directed vent ducts (1*d*) are provided in the outer sleeve wall (1*c*) of the suction/pressure piston (1).

13. Dispenser according to claim 1, characterized in that, concentrically to the locking connection (3*j*), the valve seat (5) passes into a mounting support (5*d*) for a suction tube (12).

14. Dispenser according to claim 1, characterized in that the cylinder housing (3) has an angular construction, the suction or squeezing out opening (3*f*) being continued on as an angular channel (3*k*) from the upper area (3*e*).

15. Dispenser according to claim 1, characterized in that the valve seat (5) directed towards the storage container (7) is hollow and together with the locking connection (3*g*) forms a ring step (5*e*), which is movable into a correspondingly shaped annual space (8*a*) of the flying piston (8).

16. Dispenser according to claim 1, characterized in that in the case of a cylinder housing (3) arranged in angular manner towards the axis of the storage container (7) by means of a connecting channel (3*m*) is connected an inner tube (13), which is equiaxial to the axis of the storage container (7).

17. Dispenser according to claim 1, characterized in that the inner tube (13), which is connected to the dosing device (10), is surrounded by a protective tube (14).

18. Dispenser according to claim 1, characterized in that the inner tube (13) with the dosing device (10) and protective tube (14) are provided with a removable protective cap (15).

19. Dispenser according to claim 1, characterized in that under the valve seat (5) is fixed in the cylinder housing (3) a needle holding bush (16) and that in said needle holding bush (16) is fixed a hollow piercing needle (17), whose channel (17*a*) is connected to the passage openings (5*a*).

20. Dispenser according to claim 1, characterized in that in the storage container (7) a second piston (18) is provided under the needle holding bush (16) and a flush-mounted inner contour (18*a*) corresponds to the outer contour of the needle holding bush (16), the locking connection (3*g*) and the ring step (5*e*) of the valve seat (5).

21. Dispenser according to claim 1, characterized in that the liquid mass or the viscous liquid or the liquid to be atomized and which is to be filled can be filled between the flying piston (8) and the second piston (18).

* * * * *